US006217301B1

(12) United States Patent
Kuroiwa et al.

(10) Patent No.: US 6,217,301 B1
(45) Date of Patent: Apr. 17, 2001

(54) SCROLL FLUID MACHINERY

(75) Inventors: Hiroyuki Kuroiwa; Keiji Yoshimura; Toshiaki Yoshii; Shusaku Ueda; Mikio Kajiwara, all of Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 09/403,126

(22) PCT Filed: Mar. 19, 1999

(86) PCT No.: PCT/JP99/01435

§ 371 Date: Oct. 15, 1999

§ 102(e) Date: Oct. 15, 1999

(87) PCT Pub. No.: WO99/53202

PCT Pub. Date: Oct. 21, 1999

(30) Foreign Application Priority Data

Apr. 8, 1998 (JP) ..... 10-096036

(51) Int. Cl.[7] ..... F03C 2/00
(52) U.S. Cl. ..... 418/55.2
(58) Field of Search ..... 418/55.2

(56) References Cited

U.S. PATENT DOCUMENTS

| | | | | |
|---|---|---|---|---|
| 4,547,137 | * | 10/1985 | Terauchi et al. | 418/55.2 |
| 4,781,549 | * | 11/1988 | Caillat | 418/55.2 |
| 5,022,834 | * | 6/1991 | Etemad et al. | 418/55.2 |
| 5,037,279 | * | 8/1991 | Suefuji et al. | 418/55.2 |
| 5,056,336 | * | 10/1991 | Harrison | 418/55.2 |
| 5,059,102 | * | 10/1991 | Tokumitsu et al. | 418/55.2 |
| 5,151,020 | * | 9/1992 | Mori et al. | 418/55.2 |
| 5,249,943 | * | 10/1993 | Kuroki et al. | 418/55.2 |
| 5,427,513 | * | 6/1995 | Yamada et al. | 418/55.2 |

FOREIGN PATENT DOCUMENTS

| | | | | |
|---|---|---|---|---|
| 0279646 | * | 8/1988 | (EP) | 418/55.2 |
| 56-020701 | | 2/1981 | (JP) . | |
| 356-020701 | * | 2/1981 | (JP) | 418/55.2 |
| 58-135393 | | 8/1983 | (JP) . | |
| 60-252102 | | 12/1985 | (JP) . | |
| 360-252102 | * | 12/1985 | (JP) | 418/55.2 |
| 61-175293 | | 8/1986 | (JP) . | |
| 63-138186 | | 6/1988 | (JP) . | |
| 63-205481 | * | 8/1988 | (JP) | 418/55.2 |
| 63-255585 | * | 10/1988 | (JP) | 418/55.2 |
| 0446635 | | 3/1990 | (JP) . | |
| 405-079462 | * | 3/1993 | (JP) | 418/55.2 |
| 5-202871 | | 8/1993 | (JP) . | |
| 405-202871 | * | 8/1993 | (JP) | 418/55.2 |
| 7-119654 | | 5/1995 | (JP) . | |
| 7-119654 | * | 9/1995 | (JP) | 418/55.2 |
| 08021381 | | 1/1996 | (JP) . | |
| 8-021381 | | 1/1996 | (JP) . | |
| 408-021381 | * | 1/1996 | (JP) | 418/55.2 |

* cited by examiner

*Primary Examiner*—Thomas Denion
*Assistant Examiner*—Theresa Trieu
(74) *Attorney, Agent, or Firm*—Burns, Doane, Swecker & Mathis, LLP

(57) ABSTRACT

A plurality of compression chambers are formed between first and second spiral bodies 1 and 2, and refrigerant discharge timing advancing means is provided for advancing the timing at which refrigerant is discharged from a first compression chamber 4 which is one of a pair of compression chambers located nearest to the center, relative to the refrigerant discharge timing of the second compression chamber 5. The refrigerant discharge timing advancing means includes an extension 1*c* of the first spiral body 1 and an opening advancing portion 3*a* of a discharge port 3.

7 Claims, 2 Drawing Sheets

SCROLL FLUID MACHINERY

TECHNICAL FIELD

The present invention relates to a scroll fluid machine such as a scroll compressor and a scroll expansion device.

BACKGROUND ART

FIG. 2 illustrates first and second spiral bodies 1 and 2 in a scroll fluid machine disclosed in Japanese Patent Laying-Open No. 60-252102. In FIG. 2, the first spiral body 1 corresponds to a fixed scroll and the second spiral body 2 corresponds to a movable scroll.

As shown in FIG. 2, a discharge port 3 is provided in the vicinity of winding starting ends of the first and second spiral bodies 1 and 2 in order to discharge compressed refrigerant. A thickness t4 of the first spiral body 1 located in the vicinity of discharge port 3 is defined to be larger than a thickness t5 of a winding finishing end of the first spiral body 1. The second spiral body 2 is similarly shaped.

The increased thickness t4 of the winding starting ends of the first and second spiral bodies 1 and 2 in the vicinity of discharge port 3 can enhance the strength of the portion near the winding starting ends of the first and second spiral bodies 1 and 2, and prevent leakage of refrigerant occurring at the central portion.

However, the increased thickness at the central portion of the spiral bodies causes a problem described below. Using FIG. 3, the problem is described. FIG. 3 shows a relation between pressure and volume in a compression chamber formed by the first and second spiral bodies 1 and 2, where P1 and P1' represent the pressure in the compression chamber when refrigerant is discharged, P2 represents the pressure in the compression chamber when the refrigerant is taken in, V1 represents the volume of the compression chamber when the refrigerant is taken in, and V2 represents the volume of the compression chamber when the refrigerant is discharged.

Since the thickness t4 of the winding starting ends of the first and second spiral bodies 1 and 2 is increased as described above, an opening area of discharge port 3 is small unless the first and second spiral bodies 1 and 2 are enlarged. Discharge resistance of the refrigerant from discharge port 3 accordingly increases to excessively raise the pressure in the compression chamber from P1 to P1', for example, as shown in FIG. 3 when the refrigerant is discharged, which is referred to as phenomenon of excessive compression. As a result, an extra work W becomes necessary, leading to increase in loss.

DISCLOSURE OF THE INVENTION

The present invention is made to solve such a problem as described above. An object of the invention is to prevent occurrence of the phenomenon of excessive compression in a scroll fluid machine having a pair of spiral bodies where the thickness thereof increases in a direction from winding finishing ends toward winding starting ends.

According to the invention, a scroll fluid machine includes first and second spiral bodies having the thickness increasing in a direction from winding finishing ends toward winding starting ends, first and second compression chambers formed between the first and second spiral bodies and located on the innermost side, and a discharge port discharging compressed refrigerant successively from the first and second compression chambers. The scroll fluid machine is provided with a refrigerant discharge timing advancing means for advancing the timing at which refrigerant is discharged from the first compression chamber relative to the refrigerant discharge timing of the second compression chamber.

The refrigerant discharge timing advancing means thus provided allows the timing at which refrigerant is discharged from the first compression chamber to precede the refrigerant discharge timing of the second compression chamber. Discharge resistance of the refrigerant is accordingly reduced compared with the conventional machine to prevent the excessive compression from happening.

In the scroll fluid machine according to the invention, the first spiral body has an extension which prolongs the winding finishing end of the first spiral body to a region near the winding finishing end of the second spiral body, and the discharge port has an opening advancing portion for opening the first compression chamber earlier. The refrigerant discharge timing advancing means includes the extension and the opening advancing portion.

The extension thus provided to the first spiral body enables the pressure in the first compression chamber to rise to a desired pressure earlier than the second compression chamber, for example. The first compression chamber where the pressure attains the desired pressure can be opened relatively earlier to discharge the refrigerant, since the discharge port has the opening advancing portion. Accordingly, the timing at which the refrigerant is discharged from the first compression chamber can be made earlier than the refrigerant discharge timing of the second compression chamber, so that the discharge resistance of the refrigerant can be decreased.

The opening advancing portion is preferably formed by expanding the discharge port toward the first compression chamber.

The thickness of the winding finishing end of the first spiral body is preferably smaller than that of the winding finishing end of the second spiral body.

Preferably, the thickness of the extension gradually decreases toward the winding finishing end of the first spiral body.

The scroll fluid machine according to the invention is preferably provided with one intake port for taking in the refrigerant.

Further, the scroll fluid machine according to the invention includes a movable scroll and a fixed scroll, the first spiral body is provided at the fixed scroll, and the second spiral body is provided at the movable scroll.

The thickness of the second spiral body in the vicinity of its winding starting end is preferably larger than that of the first spiral body in the vicinity of its winding starting end, and the opening advancing portion preferably has a shape which allows the opening advancing portion to be closed temporarily by a part near the winding starting end of the second spiral body. Referring to FIG. 1, for example, an opening advancing portion (3*a*) is temporarily closed by a part near a winding starting end (2*a*) of a second spiral body (2) immediately before the refrigerant is discharged from a first compression chamber (4).

BRIEF DESCRIPTION OF THE INVENTION

BEST MODES FOR CARRYING OUT THE INVENTION

Figure 1:
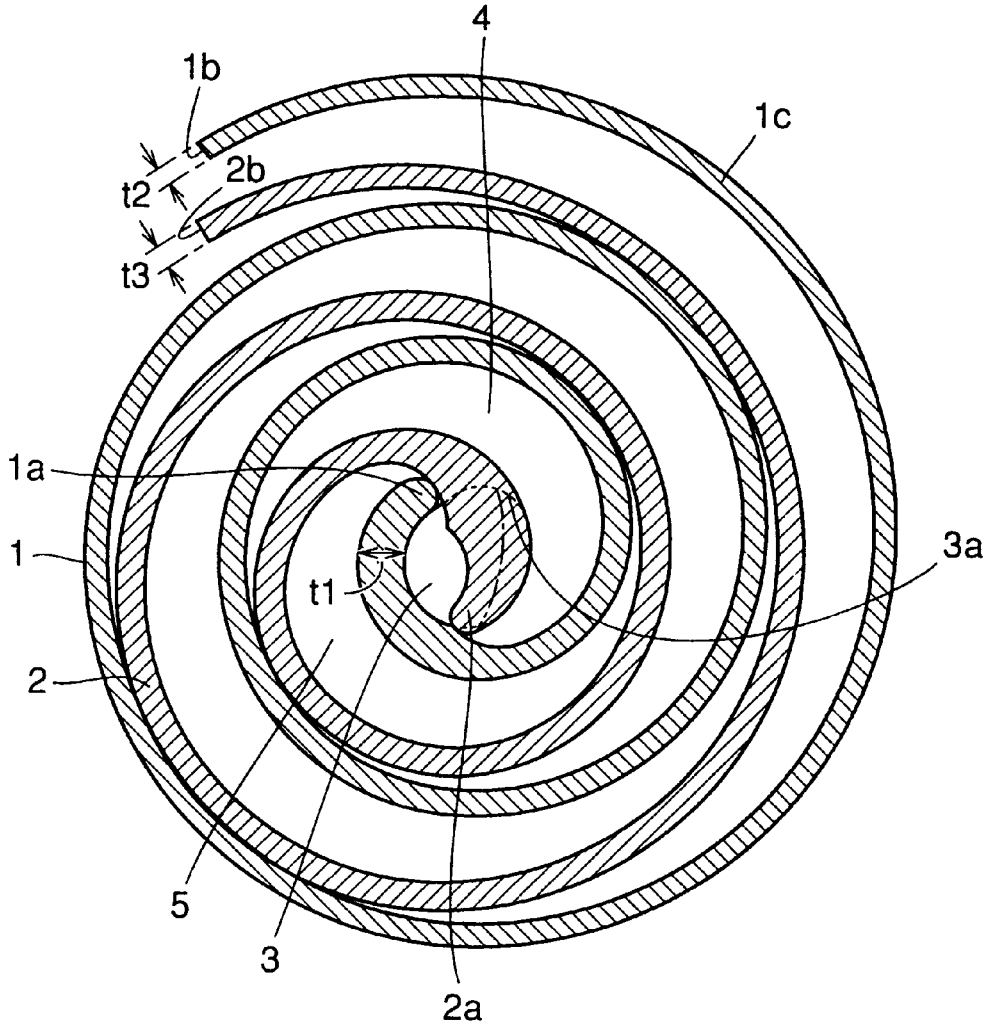
FIG. 1 is a plan view illustrating first and second spiral bodies of a scroll fluid machine according to one embodiment of the invention.
Figure 2:
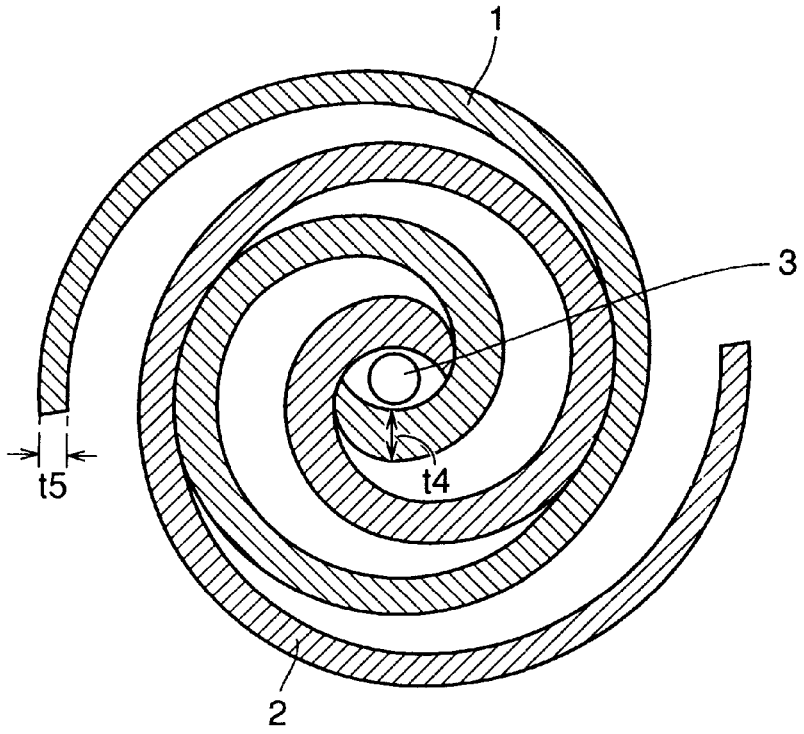
FIG.2 PRIOR ART
FIG. 2 is a plan view illustrating first and second spiral bodies in a conventional scroll fluid machine.
Figure 3:
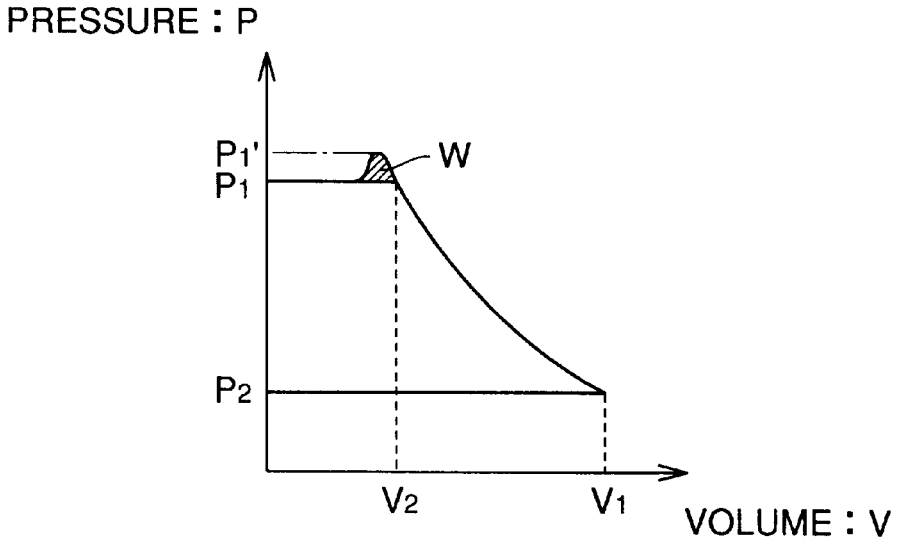
FIG.3 PRIOR ART
FIG. 3 illustrates a relation between pressure and volume in a compression chamber.

One embodiment of the invention is hereinafter described using FIG. 1. FIG. 1 is a plan view illustrating first and second spiral bodies according to the one embodiment of the invention.

Referring to FIG. 1, a scroll fluid machine according to the invention includes a fixed scroll having the first spiral body 1, and a movable scroll having the second spiral body 2. A plurality of compression chambers, represented by first and second compression chambers 4 and 5 located nearest to the center, are formed between the first and second spiral bodies 1 and 2.

The first spiral body 1 includes a winding starting end 1*a*, a winding finishing end 1*b*, and an extension 1*c*. A thickness t1 of winding starting end 1*a* is defined to be greater than a thickness t2 of winding finishing end 1*b*. Specifically, the shape of the first spiral body 1 is selected such that the thickness of the spiral body gradually increases in a direction from winding finishing end 1*b* toward winding starting end 1*a*. Extension 1*c* is generated by extending winding finishing end 1*b* by approximately 180° C. as shown in FIG. 1. Such extension 1*c* enables pressure in the first compression chamber 4 to rise to a desired pressure earlier than the second compression chamber 5. The second spiral body 2 also includes a winding starting end 2*a* and a winding finishing end 2*b*, and the thickness thereof increases in a direction from winding finishing end 2*b* toward winding starting end 2*a*. Winding finishing end 2*b* is located in the vicinity of winding finishing end 1*b*, and the thickness t2 of winding finishing end 1*b* is smaller than a thickness t3 of winding finishing end 2*b*. The reason is that the first spiral body 1 has extension 1*c* and the thickness thereof gradually decreases toward winding finishing end 1*b* even at extension 1*c*.

The fixed scroll located in the vicinity of winding starting ends 1*a* and 2*a* is provided with a discharge port 3 for discharging compressed refrigerant. Discharge port 3 includes an opening advancing portion 3*a* for opening the first compression chamber 4 earlier. A boundary between discharge port 3 and opening advancing portion 3*a* is indicated by an imaginary line in FIG. 1 for convenience of description.

The first compression chamber 4 is formed by an inner surface of the first spiral body 1 and an outer surface of the second spiral body 2, and the pressure therein increases to attain a desired pressure earlier than the second compression chamber 5 since the first spiral body 1 has extension 1*c*. Because opening advancing portion 3*a* is provided at discharge port 3, the first compression chamber 4 which has attained the desired pressure earlier than the second compression chamber 5 can be opened earlier. Accordingly, the timing at which the refrigerant is discharged from the second compression chamber 5 is delayed relative to the refrigerant discharge timing of the first compression chamber 4, and the discharge resistance of the refrigerant can thus be decreased. As a result, occurrence of the excessive compression state can effectively be avoided to reduce loss of the scroll fluid machine.

Although description of the embodiment above is presented for the case in which extension 1*c* and opening advancing portion 3*a* are provided as refrigerant discharge timing advancing means for advancing the timing at which refrigerant is discharged from the first compression chamber 4, another scheme may be employed for advancing the refrigerant discharge timing of the first compression chamber 4.

Discharge port 3 can be produced with a sufficient margin in the central portion of the first spiral body 1 since the thickness of extension 1*c* can be made smaller than the thickness t3 of the winding finishing end 2*b*. Accordingly, the opening area of discharge port 3 can be increased to further decrease discharge resistance.

In addition, extension 1*c* thus provided enables intake ports (not shown) for taking in the refrigerant to be integrated into one location, and the loss in inlet pressure and excessive inlet heating can be decreased.

Using the scroll fluid machine according to the invention, occurrence of the state of excessive compression can advantageously be avoided to reduce the loss due to the excessive compression.

Industrial Applicability

The present invention is advantageously applicable to a scroll fluid machine.

What is claimed is:

1. A scroll fluid machine including a first and second spiral bodies having a thickness increasing in a direction from winding finishing ends toward winding starting ends first and second compression chamber formed between the first and second spiral bodies to be located on the innermost side, and a discharge port for discharging compressed refrigerant successively from the first and second compression chambers, said scroll fluid machine includes refrigerant discharge timing advancing means for advancing a timing at which refrigerant is discharged from said first compression chamber relative to a timing at which refrigerant is discharged from said second compression chamber;

said first spiral body includes an extension extending the winding finishing end near to the winding finishing end of said second spiral body;

said discharge port includes an opening advancing portion for opening said first compression chamber earlier; and said refrigerant discharge timing advancing means includes said extension and said opening advancing portion.

2. The scroll fluid machine according to claim 1, wherein said opening advancing portion is formed by expanding said discharge port toward said first compression chamber.

3. The scroll fluid machine according to claim 1, wherein a thickness of the winding finishing end of said first spiral body is smaller than a thickness of the winding finishing end of said second spiral body.

4. The scroll fluid machine according to claim 1, wherein a thickness of said extension gradually decreases toward the winding finishing end of said first spiral body.

5. The scroll fluid machine according to claim 1, including one intake port for taking in refrigerant.

6. The scroll fluid machine according to claim 1, including a movable scroll and a fixed scroll, wherein said first spiral body is provided at said fixed scroll, and said second spiral body is provided at said movable scroll.

7. The scroll fluid machine according to claim 6, wherein the thickness of said second spiral body in the vicinity of its winding starting end is larger than the thickness of said first spiral body in the vicinity of its winding starting end, and said opening advancing portion has a shape which allows said opening advancing portion to be closed temporarily by said second spiral body in the vicinity of the winding starting end.

* * * * *